US007218194B2

(12) United States Patent
Habboosh

(10) Patent No.: US 7,218,194 B2
(45) Date of Patent: May 15, 2007

(54) TAMPERPROOF MAGNETIC SWITCH ASSEMBLY

(75) Inventor: Samir W. Habboosh, Hamden, CT (US)

(73) Assignee: Harco Laboratories, Inc., Branford, CT (US)

( * ) Notice: Subject to any disclaimer, the term of this patent is extended or adjusted under 35 U.S.C. 154(b) by 73 days.

(21) Appl. No.: 11/203,497

(22) Filed: Aug. 12, 2005

(65) Prior Publication Data

US 2007/0035368 A1 Feb. 15, 2007

(51) Int. Cl.
*H01H 9/00* (2006.01)

(52) U.S. Cl. ..... 335/205; 335/206; 335/207

(58) Field of Classification Search ..... 335/205–208; 200/61.45 M

See application file for complete search history.

(56) References Cited

U.S. PATENT DOCUMENTS

| | | | | |
|---|---|---|---|---|
| 4,210,889 | A | 7/1980 | Holce | |
| 4,287,512 | A | 9/1981 | Combs | |
| 4,651,138 | A * | 3/1987 | Morrison | 340/510 |
| 4,945,340 | A | 7/1990 | Brill | |
| 5,233,323 | A | 8/1993 | Burkett et al. | |
| 5,332,992 | A | 7/1994 | Woods | |
| 5,633,626 | A * | 5/1997 | Cawthorne | 340/545.1 |
| 5,668,533 | A | 9/1997 | Jackson, Jr. et al. | |
| 5,673,021 | A | 9/1997 | Woods | |
| 5,877,664 | A * | 3/1999 | Jackson, Jr. | 335/205 |
| 5,929,731 | A | 7/1999 | Jackson, Jr. | 335/207 |
| 6,506,987 | B1 | 1/2003 | Woods | |
| 6,603,378 | B1 | 8/2003 | Collins | |
| 6,803,845 | B2 | 10/2004 | Woods | |
| 2003/0052780 | A1 | 3/2003 | Buckely | |

* cited by examiner

*Primary Examiner*—Ramon M. Barrera
(74) *Attorney, Agent, or Firm*—St. Onge Steward Johnston & Reens LLC

(57) ABSTRACT

An improved magnetic switching assembly for detecting relative movement between first and second members, the switching assembly including a flux directing device for channeling a majority of applied magnetic flux away from a shiftable body such that an externally applied magnetic field cannot be used to defeat the magnetic switch assembly. The improved magnetic switching assembly also including at least one tamper switch to detect application of an external magnetic field.

29 Claims, 10 Drawing Sheets

TAMPERPROOF MAGNETIC SWITCH ASSEMBLY

FIELD OF THE INVENTION

The present invention is directed toward magnetic switches that may be used as part of alarm systems to detect relative movement between a first and a second member such as a door and doorframe. More specifically, the present invention provides an improved magnetic switch assembly especially designed to defeat attempted unauthorized external manipulation.

BACKGROUND OF THE INVENTION

Security alarm systems often use magnetic switches attached to doors and windows for detecting unauthorized openings. One type of magnetic switch utilized is a reed switch. However, these switches are subject to unauthorized manipulation through use of, for example, an external magnet. Specifically, a compact high energy magnet may be positioned in proximity to the reed switch, which will then be operated (to either open or close depending on the control scheme). Once accomplished, an intruder can open the door or window without triggering the alarm system.

A number of magnetic switches have been proposed in the past to overcome the inherent limitation and serious deficiencies of reed switches including, U.S. Pat. Nos. 5,997,873; 5,530,428; 5,332,992; 5,673,021; 5,880,659; and 6,506,987. These switches typically include a pair of spaced apart switch elements with a shiftable body (e.g., a spherical ball) movable between a first position where the ball is in simultaneous contact with both switch elements and a second position out of simultaneous contact with the switch elements. An alarm circuit may be electrically coupled to the switch elements so as to detect movement of the body. However, these switches may still be manipulated by an externally applied magnetic force.

Other systems have been presented that also offer limited protection from external magnetic manipulation including, U.S. Pat. Nos. 6,506,987; 6,603,378; and 6,803,845. While the switch arrangements in these patents represent an improvement in the field, these switch arrangements suffer from some inherent problems. For example, while offering a degree of security against external magnetic fields in one plane, these switches may still be defeated by introducing an external magnetic force in one of several or in multiple planes. Another problem presented by these switches is that they are prone to misalignment, causing problems with accurate functioning of the system. In addition, these switches may be highly sensitive to the material to which they are mounted. For example, if these switches are mounted to a steel base, a portion of the magnetic field strength may be drawn away negatively affecting system performance.

What is desired then, is a system and method that will provide an improved magnetic switching device that is essentially undefeatable by application of an externally applied magnetic field.

It is further desired to provide a system and method that provides an improved magnetic switching device that may not be defeated with the application of an external magnetic field in one of several or multiple planes.

It is still further desired to provide a system and method that provides an improved magnetic switching device that reduces sensitivity to system misalignment.

It is yet further desired to provide a system and method that provides an improved magnetic switching device that is relatively insensitive to the material to which they are mounted.

SUMMARY OF THE INVENTION

These and other objects are achieved by the provision of an improved magnetic switching arrangement that detects relative movement between first and second members such as doors/door frames and are typically used to detect when one of the members is moved from a first position in close proximity with the second member, to a second position where the one member is moved to a remote position. The switch arrangement includes, a switch assembly, for mounting to the first member, the switch assembly having first and second switch elements in spaced relationship to each other, an electrically conductive body shiftable between a first position where the body is in simultaneous contact with both of the switch elements, and a second position where the body is not in contact with both of the switch elements. The switch assembly further includes a first magnetically attractive component adjacent the contacts in the first structural member and a second magnetically attractive component for mounting to the second member. The first and second attractive components are selected and located so that, when the first and second structural members are in the first, adjacent position, the body will be shifted to a position out of simultaneous contact with said first and second switch elements by virtue of a magnetic attraction between the body and the second attractive component. When the first and second members are in the second, remote position, the body will be shifted to a position into simultaneous contact with both of said switch elements by virtue of a magnetic attraction between the body and the first attractive component.

It is contemplated that the shiftable switch body may be permanently magnetized and the first and second attractive components may be complementary magnets or formed of steel or other magnetically susceptible material. Alternately, the first and second attractive components may be permanently magnetic whereas the shiftable body is formed of steel or other material, which is magnetically attractive to the components.

The improved magnetic switching arrangement further comprises in one advantageous embodiment, a magnetic flux director or concentrator. The director provides a lower reluctance path for an applied magnetic field thereby acting to "absorb" these fields from the surrounding space. These fields leave the director in regions of varying flux density around its space as a consequence of the material composition and design of the device. The fields emanate from the surfaces of the director with varying but relatively uniform energy levels. This field couples to the surrounding switches and/or bias rings within their narrow actuation angle creating localized balanced magnetic circuits. When the circuit is unbalanced due to the movement of the actuator or the introduction of an externally applied field the switches change state.

For example, the second attractive component may be provided as a relatively large permanent magnet that overcomes the attractive force of the relatively small first attractive component. Even though the flux director acts to reduce the magnetic flux applied to the shiftable switch body, there is still enough magnetic flux due to the relatively large size of the second attractive component that reaches the shiftable switch body, which overcomes the attractive force of the first attractive component. Therefore, in order to affect the shiftable switch body one would have to use a relatively large magnet that produces a magnetic field at least as strong as the second attractive component. This however, cannot be accomplished for a number of reasons. First, the relative spacing between the first and second members is relatively small, e.g. the door and doorframe will be provided with a relatively close fit. In this manner, a potential intruder is prevented from inserting the relatively large and bulky magnet required to shift the switch body due to the flux director, between the first and second members (e.g. between the door and doorframe). While a very low profile magnet and therefore a relatively weak magnet may be inserted, the switch is prevented from actuating.

A second reason it that if the potential intruder were to position the relatively large and powerful magnet on the surface of one of the members in order to actuate the switch body, a tamper switch will be actuated causing an alarm condition. Multiple tamper switches may be positioned to actuate upon the application of a magnetic field in virtually any plane in which the magnetic field component is located. Therefore, magnetic flux may only be applied in one plane from the outside of the device; however, the spacing is very small preventing a potential intruder from actuating the switch body. The presence of a large drive magnet makes it very difficult to permanently place a defeat magnet in the plane of operation. The high field strength of the drive magnet will likely attract the defeat magnet and dislodge it from the defeat actuation surface.

The provision of the flux director also minimizes the problem of misalignment associated with prior art devices. This is because the flux director has a tendency to gather in and channel any attractive force directed at the flux director. Additionally, the flux director helps to desensitize the switching device to the composition of the mounting surface due to the fact that magnetic flux is gathered and concentrated within a relatively narrow angle for actuation of the shiftable body. This means that, even if the overall magnetic field strength is affected due to the mounting material composition, such as for instance, steel, the system will still function properly because of the concentrated and directed magnetic field.

Also provided in the improved magnetic switching arrangement in another advantageous embodiment is a return flux director, which may be used to gather return magnetic flux and direct it back to the second attractive component. This further reduces and/or eliminates the problems associated with misalignment and further desensitizes the arrangement to the composition of the members.

Still further provided in another advantageous embodiment are various biasing rings that are positioned to encircle the shiftable switch body to provide for increased repeatability of the switching device. The biasing rings are provided to ensure that the switch body will actuate at substantially identical applied signal levels. It is also contemplated that multiple shiftable bodies (e.g. main and auxiliary switch contact arrangements) may effectively be utilized in connection with the flux director. The location of the biasing rings may further be varied depending upon the location of the multiple magnetic switches. Additionally, multiple attractive components may effectively be utilized to further increase system performance and repeatability.

Accordingly, in one advantageous embodiment, a magnetic switching device for detecting relative movement between a first and a second member is provided comprising, a switch assembly for mounting to the first member. In this embodiment the switch assembly includes, a first switch element and a second switch element, the second switch element positioned apart from the first switch element, an electrically conductive shiftable body, a first attractive component, and a flux director positioned in proximity to the shiftable body. The shiftable body is provided such that it is movable between a first position where the shiftable body is in simultaneous contact with the first and second switch elements, and a second position where the shiftable body is out of simultaneous contact with the first and second switch elements. The magnetic switching device further comprises a second attractive component for mounting to the second member. The director provides a lower reluctance path for an applied magnetic field thereby acting to "absorb" these fields from the surrounding space. The magnetic fields emanating from the director couples to the surrounding switches and/or bias rings, which when used comprise the first attractive component within their narrow actuation angle. In addition, the first and second attractive components are positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions.

In another advantageous embodiment a magnetic switching device for detecting relative movement between a first and a second member is provided comprising, a switch assembly that has an electrically conductive shiftable body that shifts between simultaneous contact with two switch elements and non-simultaneous contact with the two switch elements based upon applied magnetic fields generated by first and second attractive components. In this advantageous embodiment the switch assembly further includes a flux director positioned in proximity with the shiftable body. The director provides a lower reluctance path for an applied magnetic field thereby acting to "absorb" these fields from the surrounding space. The magnetic fields emanating from the director couples to the surrounding switches and/or bias rings, which when used comprise the first attractive component within their narrow actuation angle. In addition, the first and second attractive components are positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions.

In still another advantageous embodiment, a magnetic switching device for detecting relative movement between a first and a second member and for sending a signal indicative of the relative movement to a control panel is provided comprising, a switch assembly that has an electrically conductive shiftable body that shifts between simultaneous contact with two switch elements and non-simultaneous contact with the two switch elements based upon applied magnetic fields generated by first and second attractive components. The switch assembly further including, the first and second attractive components being positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions. The magnetic switching device further comprises, a resistor network positioned in the magnetic switching device for sending, via a set of control leads, a signal indicative of the relative movement between a first and a second member to the control panel.

Other objects of the invention and its particular features and advantages will become more apparent from consideration of the following drawings and accompanying detailed description.

DETAILED DESCRIPTION OF THE DRAWINGS

Figure 1:
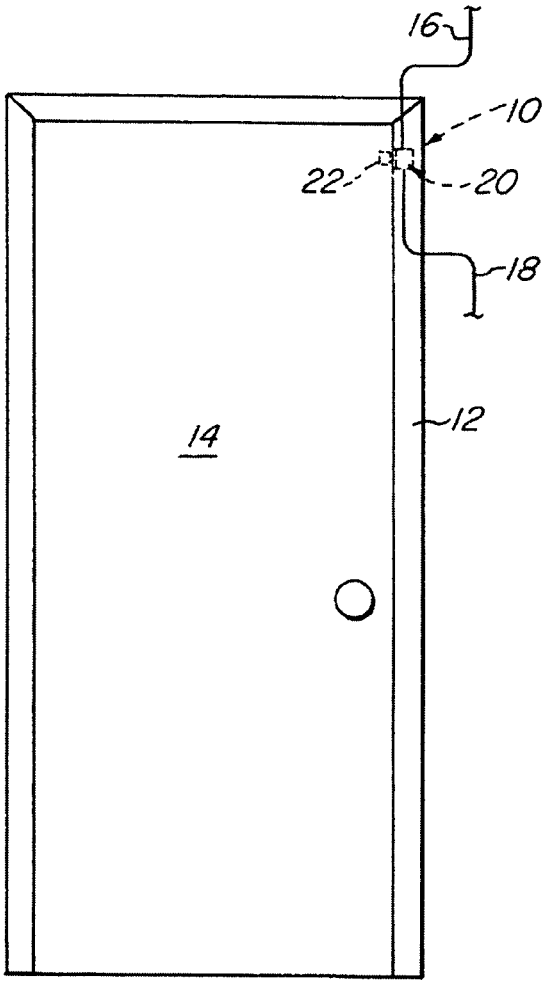
FIG. 1 illustrates a magnetic switch depicted in use for protecting a door.
Figure 2:
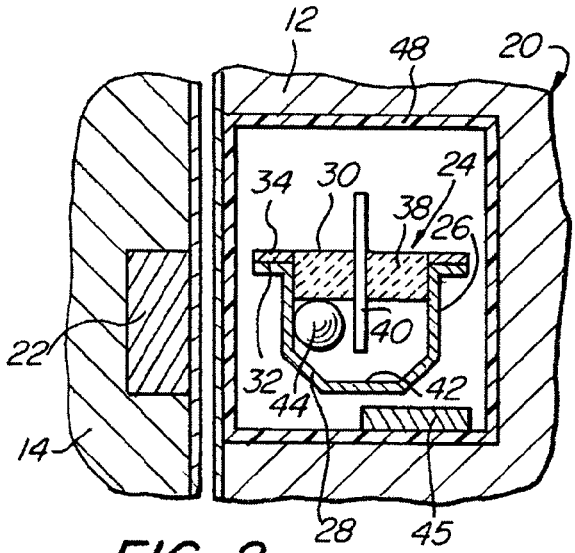
FIG. 2 depicts the construction and operation of the magnetic switch when the door is closed according to FIG. 1.

Turning now to the drawings, FIG. 1 illustrates a magnetic switch 10 (dashed lines) shown used with a doorframe 12 and door 14. Electrical leads 16, 18 are operatively coupled with the switch 10. While FIG. 2 illustrates a contact that is normally open when the door is in the secure position, it is contemplated that a normally closed contact when the door is in the secure position is equally applicable.

The switch 10 includes a switch assembly 20 secured to frame 12, as well as a second attractive component 22, which is mounted to door 14. The switch assembly 20 may include a housing 24 having a circumscribing annular sidewall 26, an integral concavo-convex bottom wall 28 and a top cover 30. Preferably, the integral sidewall and bottom wall 26, 28 presents a circumscribing flange 32 and is formed of a suitable non-magnetic, electrically conductive material, such as for instance, cupro-nickel alloy. The top cover 30 includes an outboard flange 34 adapted to mate with flange 32, and a central glass or ceramic nonconductive plug 38. The flange 34 may also be formed of a suitable non-magnetic, electrically conductive material.

The assembly 20 also includes an elongated substantially upright first switch element 40 which as shown extends downwardly through plug 38 to a point spaced above bottom wall 28, the latter having an annular contact surface 42 which serves as the second switch element.

A shiftable body 44 is located within housing 24 and is formed of electrically conductive material. Preferred configurations of body 44 include substantially spherical balls as well as cylinders.

The overall assembly 20 further includes a first attractive component 45 associated with housing 24. In the illustrated embodiment, the component 45 is situated slightly below housing 24 and is laterally offset relative to the central axis of the housing.

The top cover 30 is welded to sidewall 26 at the facing contact between the flanges 32 and 34, thereby creating a hermetically sealed internal chamber 46. It is preferred that the chamber 46 be filled with an inert gas such as for example, argon.

As illustrated, the housing 24 and first attractive component 45 may be located within a mounting box 48 positioned within an appropriately sized recess in frame 12. However, such a mounting arrangement is not essential.

The second attractive component 22 is mounted to door 14, for example, near the top of the door. When the door 14 is closed relative to frame 12, it will be seen that the component 22 is directly in juxtaposition to housing 24. When the door 14 is opened, the component 22 is shifted away from the housing 24.

The materials used in fabricating the first and second attractive components 45, 22 and body 44 can be varied, so long as the operational principles of the switch 10 are maintained. For example, and in preferred forms, the body 44 may be formed of a permanently magnetized material. Suitable materials include an appropriate samarium-cobalt alloy with a thin (usually about 0.001–0.002") outer coating of nickel for wear purposes or neodynium iron boron. In such an instance, the attractive components 45 and 22 may be formed of steel (e.g., partially annealed steel) or of complementary magnetized material relative to the body 44. Alternately, the first and second components 45, 22 may be formed of permanently magnetized material while the body 44 is formed of any material, which is magnetically attracted to the first and second components. As explained in more detail hereafter, the goal in selecting the materials for the components 45 and 22 and body 44 is to assure that the body 44 may be appropriately magnetically shifted when the door 14 is moved between the closed and open positions thereof.

Specifically, and referring to FIG. 2, it will be seen that, when the door 14 is closed relative to frame 12, the body 44 is shifted laterally by virtue of a magnetic attraction between the second attractive component 22 and the body 44, so as to hold the body 44 in the FIG. 2 position out of simultaneous contact with the switch elements 40, 42. Of course, in this orientation, the magnetic attraction between component 22 and body 44 is greater than and overcomes the magnetic attraction between body 44 and first attractive component 45. The offset position of the component 45 augments this differential attraction relative to body 44.

Figure 3:
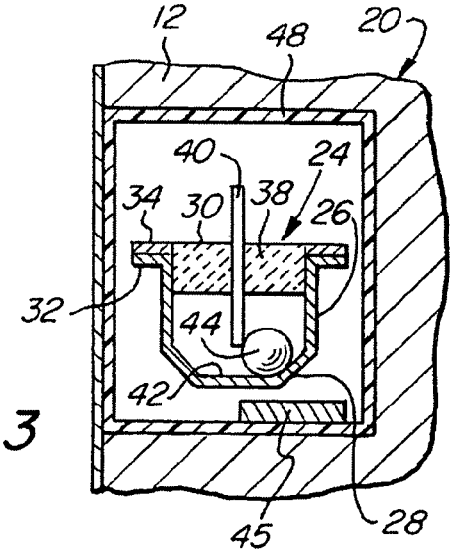
FIG. 3 is a sectional view similar to FIG. 2, but illustrating the operation of the magnetic switch when the door is open.

When the door 14 is open so that second attractive component 22 is remote from the switch assembly 20, the body 44 is magnetically shifted to the FIG. 3 position thereof, i.e., in simultaneous contact with the switch elements 40, 42. As will be readily understood, this shifting is effected because of the magnetic attraction between the body 44 and first attractive component 45.

The relative magnetic strengths or susceptibilities of the first and second components 45, 22 relative to body 44 must be considered in the design of switch 10. That is, the magnetic attraction generated between the body 44 and component 22 when the door 14 is closed must be significantly stronger than the countervailing magnetic attraction between the body 44 and the first component 45.

Figure 4:
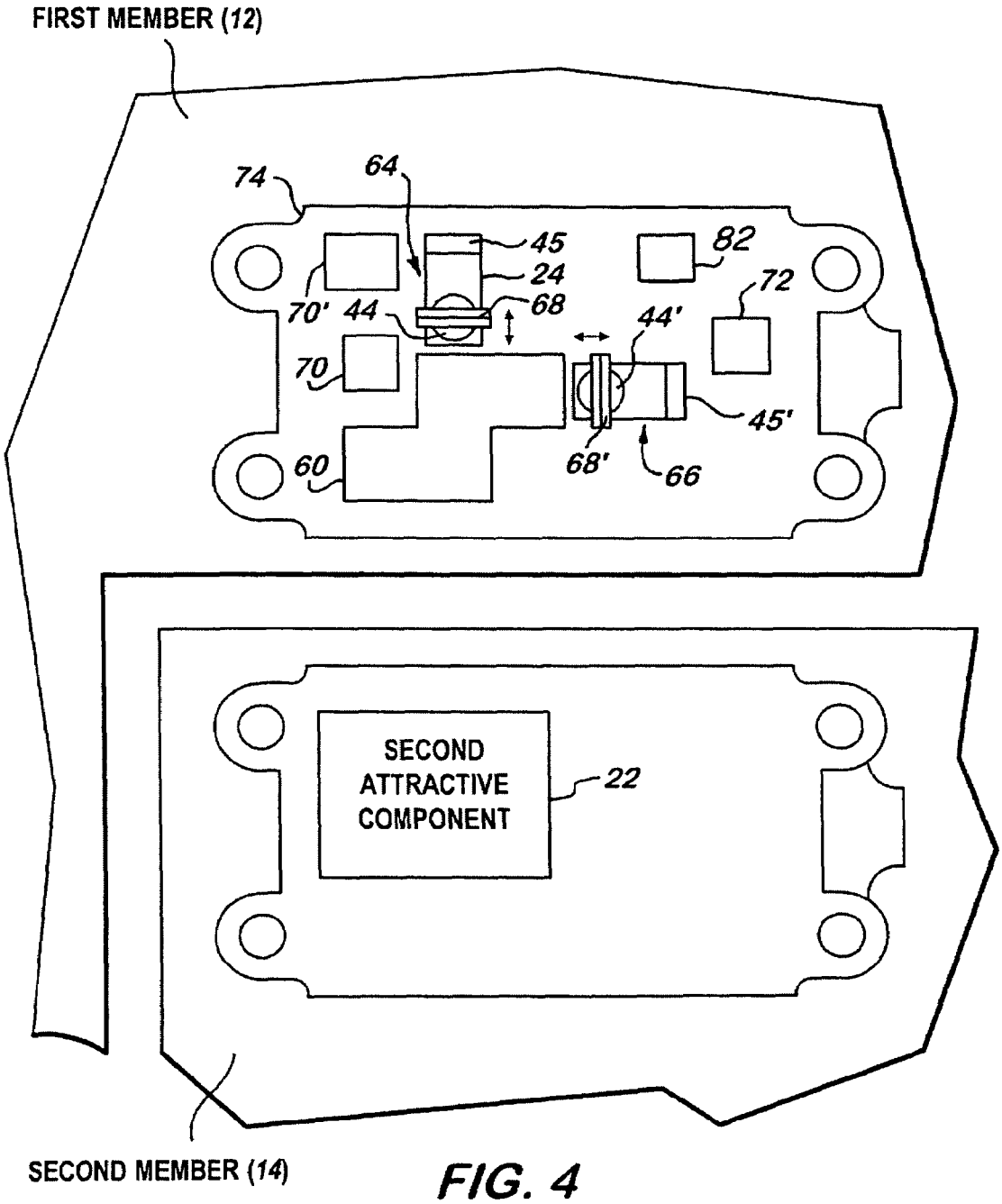
FIG. 4 is a block diagram of one advantageous embodiment of the present invention utilizing the magnetic switch according to FIG. 1.

Turning now to FIG. 4, an advantageous embodiment of the improved magnetic switching arrangement is illustrated. This configuration includes switch 10 and further includes flux director 60.

Flux director 60 provides a lower reluctance path for an applied magnetic field thereby acting to "absorb" the field from second attractive component 22. The field leaves the director in regions of varying flux density around its space as a consequence of the material composition and design of the device. The field couples to, for example, body 44 (which may comprise a door contact or switch) within its relatively narrow actuation angle creating a localized balanced magnetic circuit. However, when the circuit is unbalanced due to movement of the actuator or the introduction of an externally applied field, body 44 changes state due to interaction with magnet 45 that comprises a first attractive component in this embodiment, creating an alarm condition. The presence of a large drive magnet makes it very difficult to permanently place a defeat magnet in the plane of operation. The high field strength of the drive magnet will likely attract the defeat magnet and dislodge it from the defeat actuation surface. It is contemplated that additional door contacts or switches may be provided as desired.

Also illustrated in FIG. 4 is the internal resistor network 82, which will be discussed in greater detail in connection with FIG. 7. While the internal resistor network 82 is shown located with the components mounted to the first member 12, it is contemplated that the internal resistor network 82 may further be located with the components mounted to second member 14.

Figure 4A:
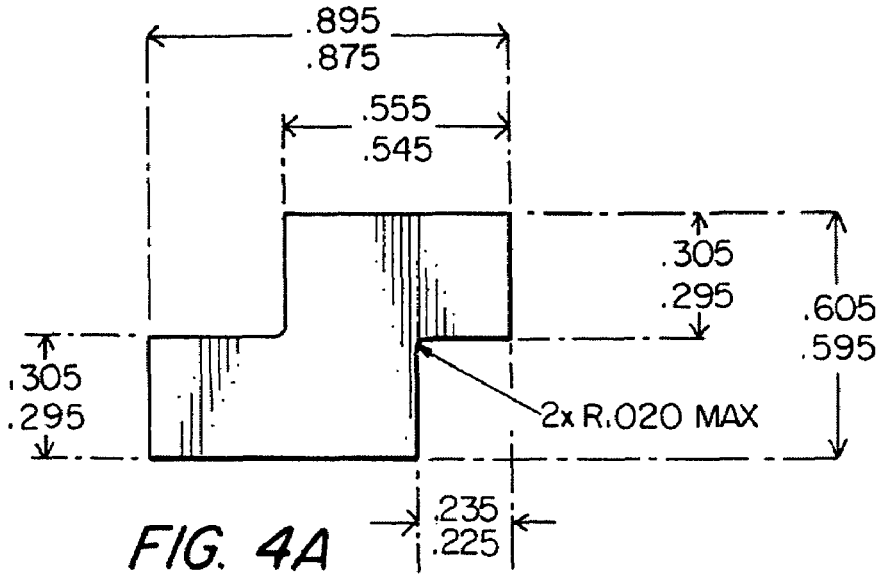
FIG. 4A is a side view showing the flux director according to FIG. 4.
Figure 4B:
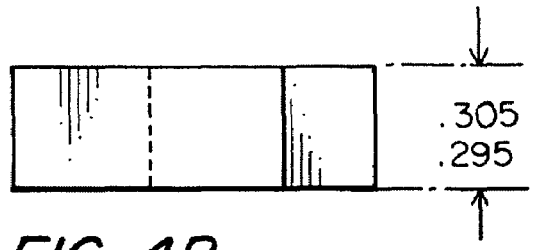
FIG. 4B is an edge view showing the flux director according to FIG. 4.

FIGS. 4A and 4B illustrate one advantageous embodiment of flux director 60 including preferable dimension ranges in inches. FIG. 4A illustrates a side view of flux director 60, while FIG. 4B shows a range of thickness measurements for flux director 60. It is contemplated that flux director 60 typically will comprise a ferrous material, but may comprise any magnetically permeable material including for example but not limited to, nickel.

Also shown in FIG. 4 is auxiliary switch 66, which is similar in operation to main switch 64. It should be noted that these switches (main switch 64, auxiliary switch 66, etc.) may be selected having any desired logic, whether normally open or normally closed and is should not be viewed as a limitation of the present invention. In one embodiment, auxiliary switch 66, includes body 44' and magnet 45', which comprises a first attractive component and may be used to switch a variety of system components as desired. Alternatively, both main switch 64 and auxiliary switch 66 may be provided with biasing rings 68, 68', which are positioned to surround body 44, 44' and comprise the first attractive components. One or more bias rings 68, 68' may be positioned around body 44, 44' as desired. Bias rings 68, 68' are provided to increase switching repeatability such that for an applied signal level or magnetic field strength, body 44, 44' will always actuate.

Figure 4C:
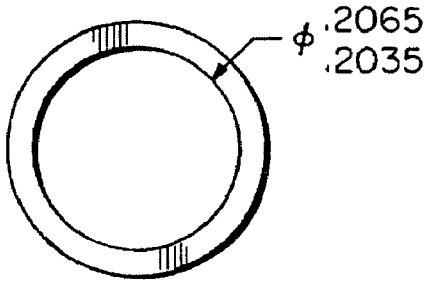
FIG. 4C is a end view showing the bias ring(s) according to FIG. 4.
Figure 4D:
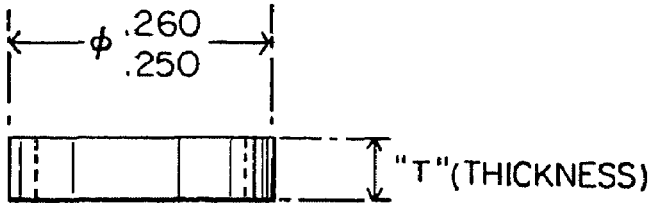
FIG. 4D is an edge view showing the bias ring(s) according to FIG. 4.

FIGS. 4C and 4C illustrate one advantageous embodiment for bias rings 68, 68' including preferable dimension ranges in inches. FIG. 4C depicts and view looking down the end of the bias ring with a preferable inside diameter (ID) provided. FIG. 4D is a side view of the bias ring providing both a preferable outside diameter (OD) measurement, and a measurement of the thickness (T) of the ring. The thickness (T) of the bias rings typically will range from about 0.01 inches to about 0.2 inches. It is contemplated that bias rings 68, 68' typically will comprise a highly permeable material, such as for example but not limited to, iron, nickel and/or combinations thereof.

Also provided is tamper switch 70, 70'. One or more tamper switches may be provided to indicate the application of an applied external magnetic field. If a potential intruder were to apply an external magnetic field to assembly 20 in a plane other than from the direction of the second attractive component 22, the applied external magnetic field would cause tamper switch(es) 70, 70' to actuate causing an alarm condition.

Also provided in FIG. 4 is pry tamper switch 72, which will indicate whether assembly 20 has been moved relative to first member 12, also, providing an alarm upon activation.

Figure 5:
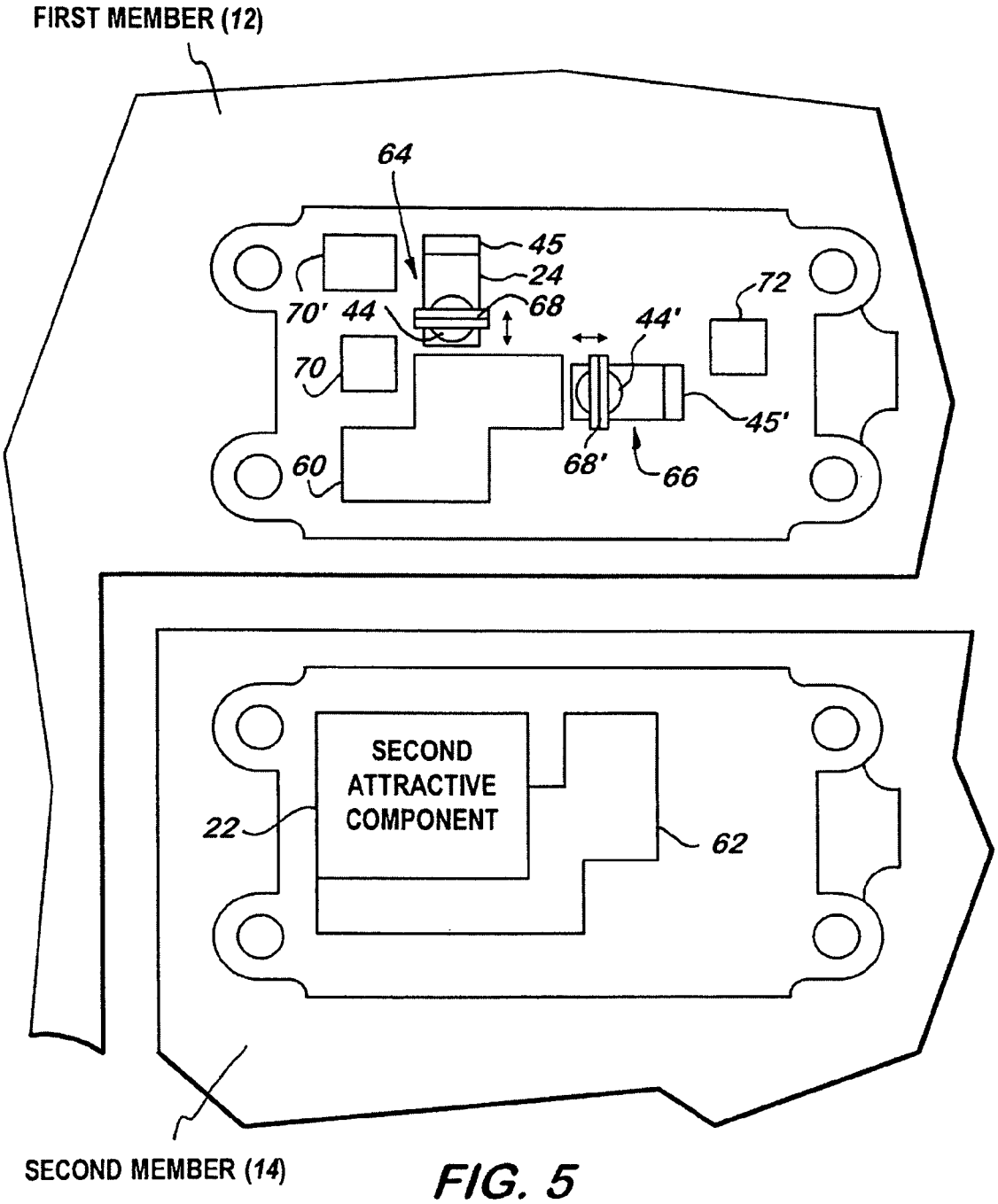
FIG. 5 is a block diagram of another advantageous embodiment of the present invention according to FIG. 4.

FIG. 5 is an illustration of yet another advantageous embodiment of the present invention similar to that described in connection with FIG. 4 but further including return flux director 62. Return flux director 62 is constructed and operates similar to flux director 60 in that applied magnetic flux is gathered and channeled as desired. In this case, magnetic flux is directed back to second attractive component 22. Return flux director 62 has a tendency to increase the magnetic field strength between switch assembly 20 and second attractive component 22. This increased field strength further desensitizes the assembly 20 to the composition of first member 12 and second member 14. In addition, misalignment problems are further reduced, and the operational gap is increased.

Figure 5A:
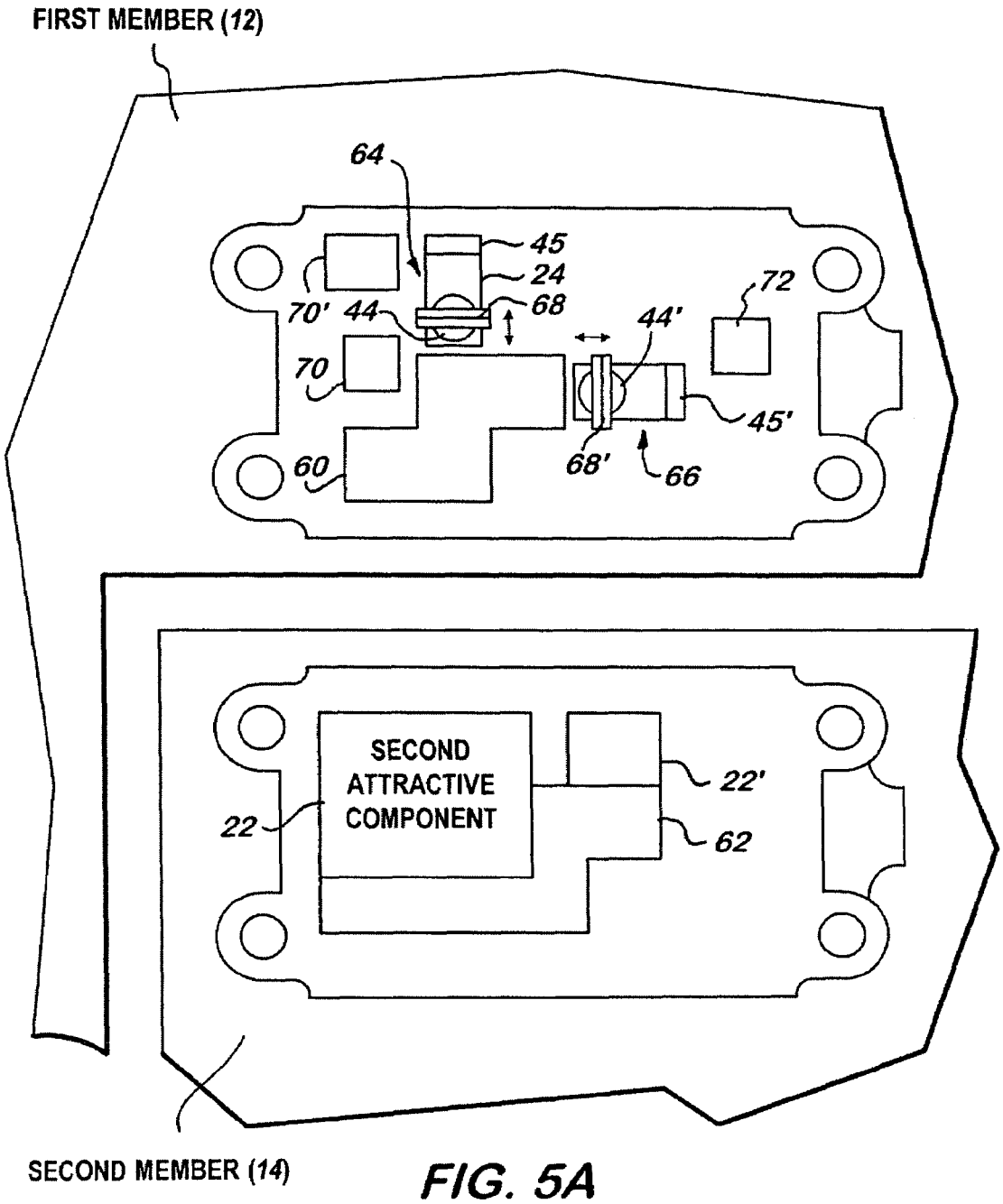
FIG. 5A is a block diagram illustrating another advantageous embodiment of the present invention according to FIG. 5.

FIG. 5A is an alternative embodiment according to FIG. 5 in which another second attractive component 22' is positioned adjacent to the return flux director 62. Providing another second attractive component 22' opposite in polarity to second attractive component 22 allows the magnetic circuit to close more tightly, increasing the flow of magnetic flux through the circuit. This in turn allows the distance between the members to be increased while maintaining a high level of circuit performance.

Figure 5B:
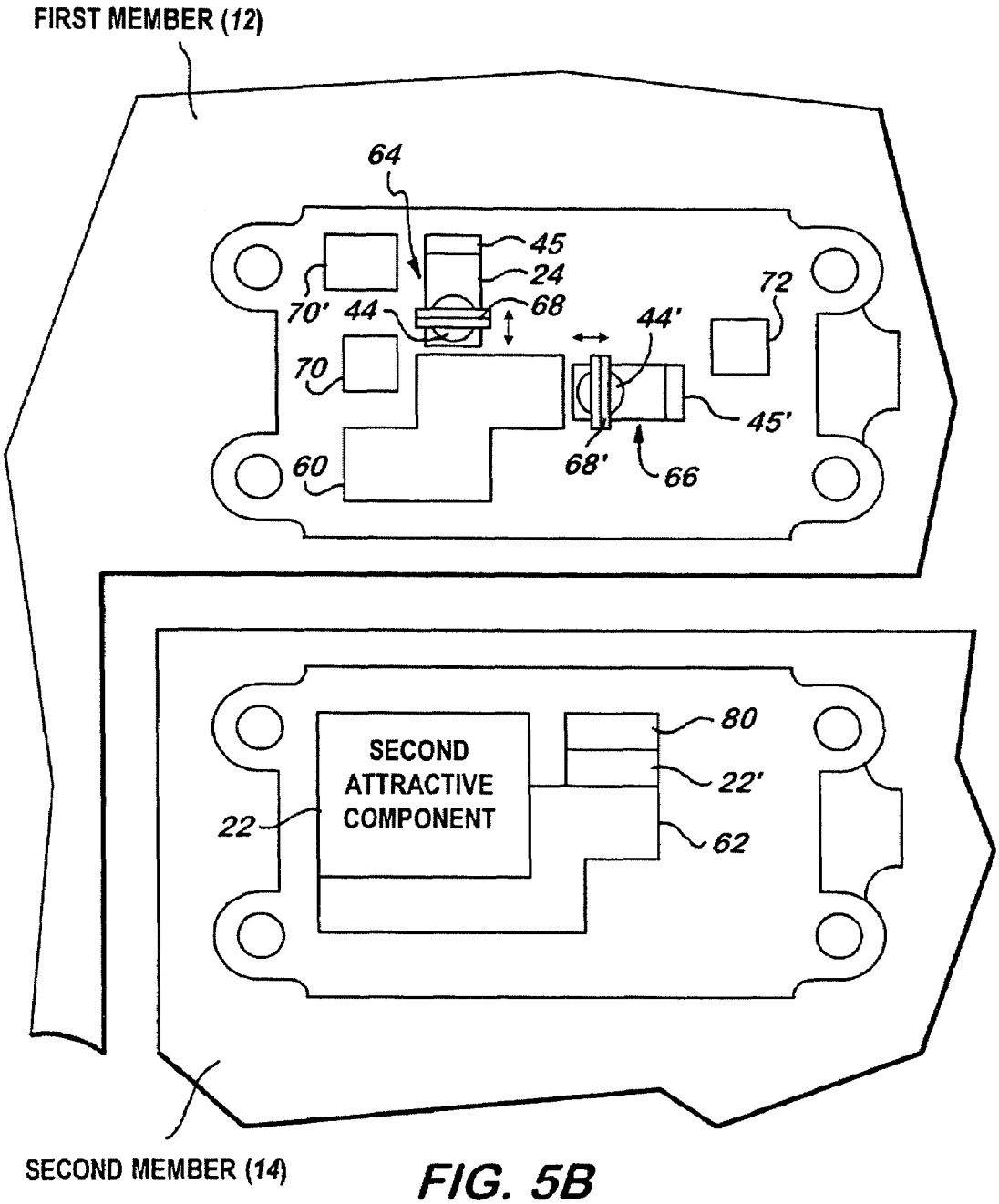
FIG. 5B is a block diagram illustrating yet another advantageous embodiment of the present invention according to FIG. 5.

FIG. 5B illustrates still another advantageous embodiment of the present invention, which is similar to that show in FIG. 5A, but further includes shim(s) 80 that may be used with and/or position adjacent to second attractive component 22'. The shim material of shim may comprise in one advantageous embodiment, a material having relatively good permeability and high saturation characteristics, including for example the material of the bias rings. While the shim(s) 80 is shown as only adjacent to second attractive component 22', it is contemplated that shim(s) 80 could extend across both second attractive component 22 and 22'.

Figure 5C:
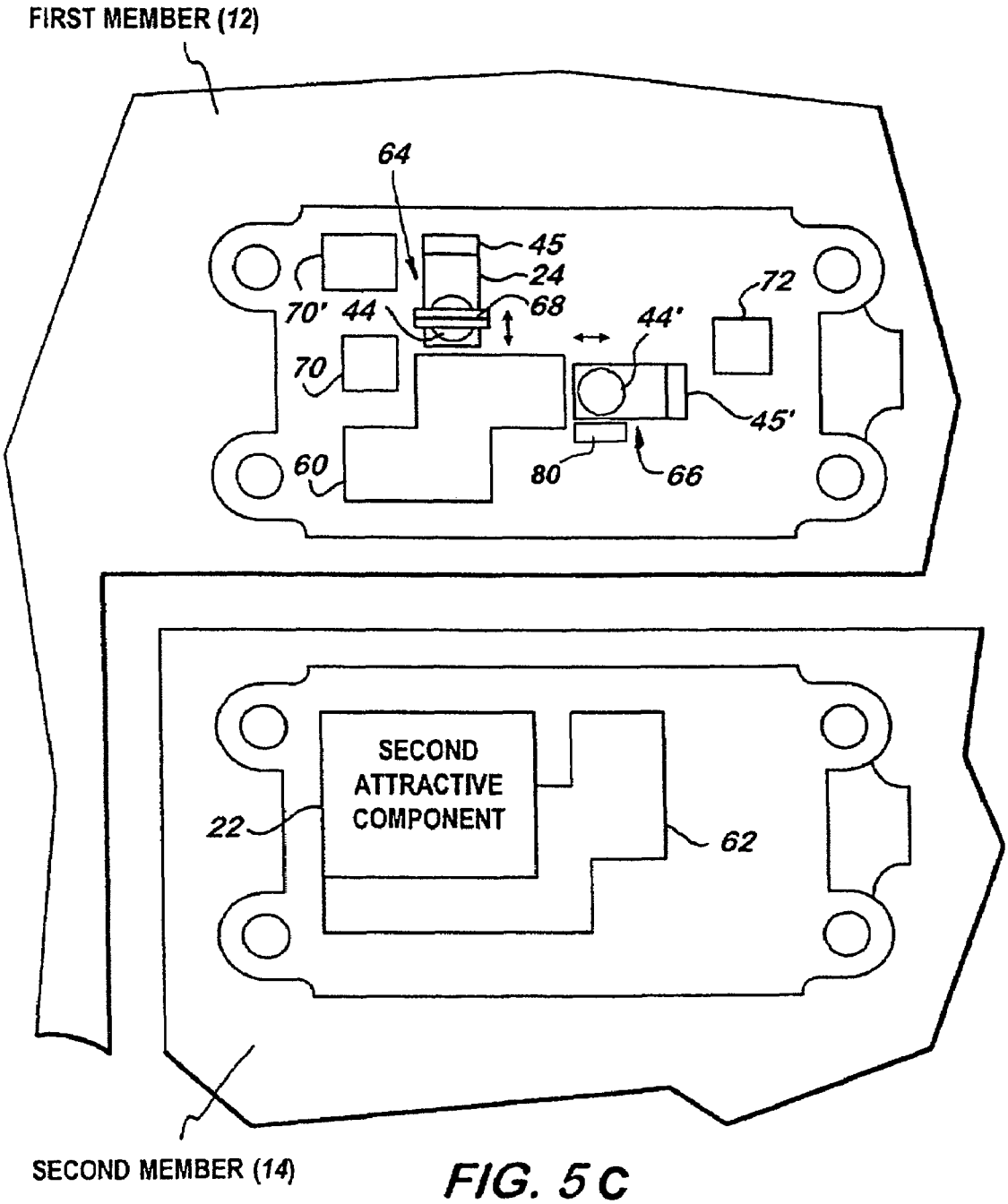
FIG. 5C is a block diagram illustrating yet another advantageous embodiment of the present invention according to FIGS. 4 and 5.

While shim(s) 80 and second attractive component 22' are shown with the component located on the second member 14, it is contemplated that they may further be located with the parts located on first member 12 or in both locations as illustrated in FIG. 5C with shim 80 positioned on first member 12 adjacent to shiftable body 44.

It is still further contemplated that the switch and/or magnet assembly 20 may be provided with a metal back plate(s) 74 for compensation purposes. Also, high permeability shims may be used in connection with second attractive component 22. The shim material of shim may comprise in one advantageous embodiment, that of bias rings or other high permeability material.

Figure 6:
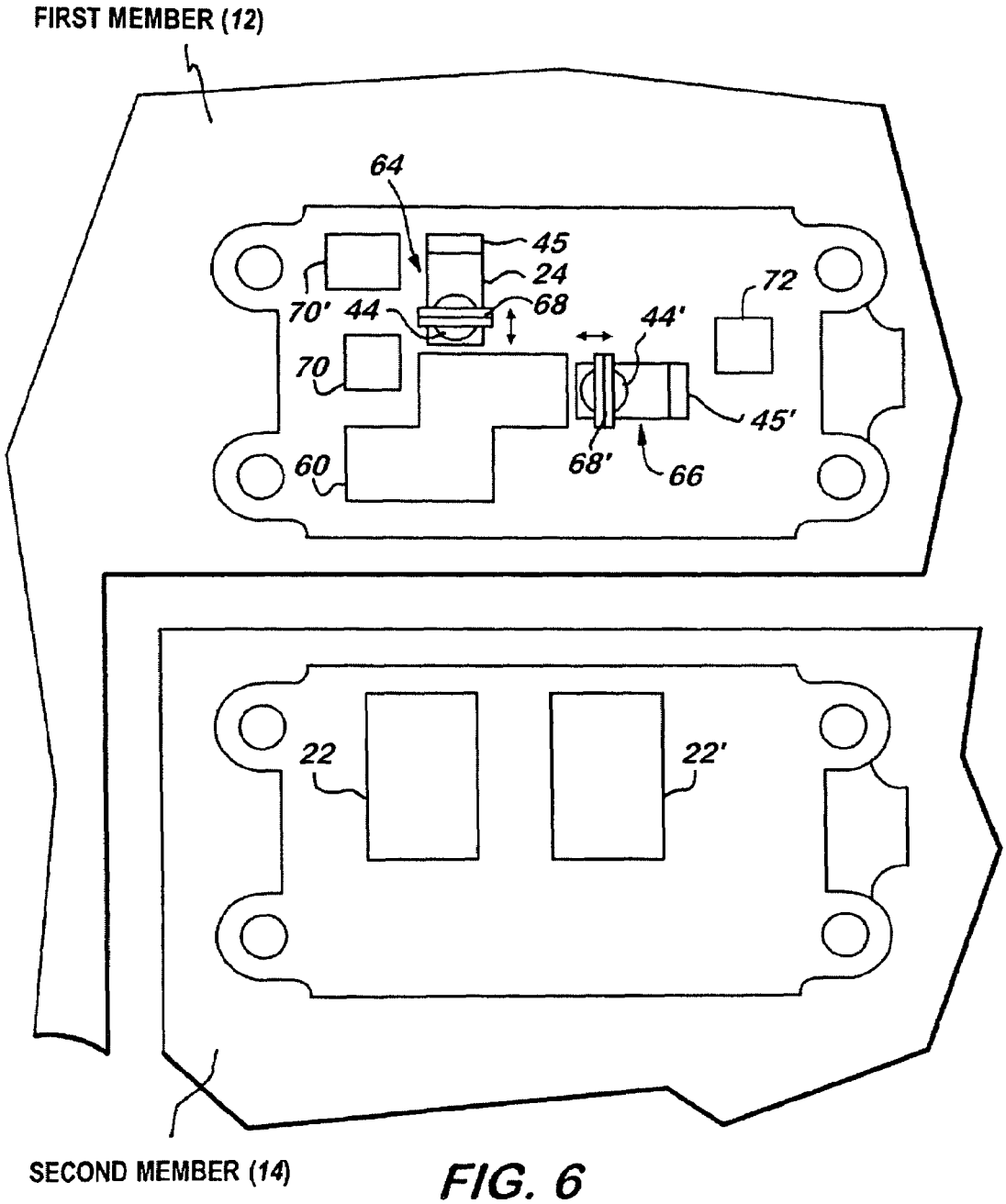
FIG. 6 is a block diagram of another advantageous embodiment of the present invention according to FIG. 4.

FIG. 6 is yet another illustration of an advantageous embodiment of the present invention including flux director 60 and two second attractive components 22, 22' positioned in second member 14. This embodiment again provides an increased magnetic field strength between the first and second members. It is also contemplated that the two second attractive components 22, 22' may be installed having opposite polarity at each end of switch assembly 20. It is also contemplated that many of these embodiments may be effectively used together in various combinations to increase overall system performance and repeatability as desired for a given application.

Figure 6A:
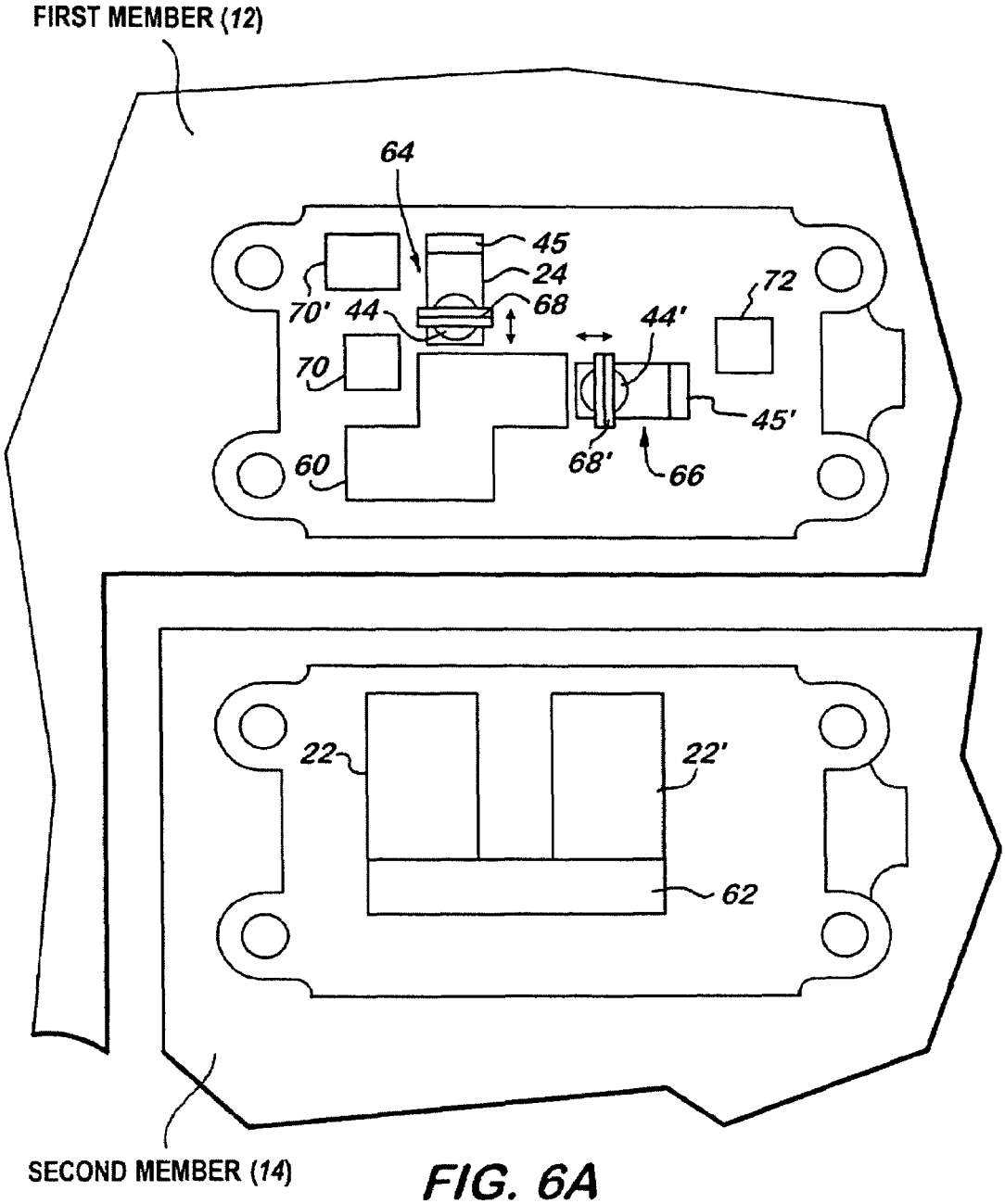
FIG. 6A is a block diagram of still another advantageous embodiment of the present invention according to FIG. 6.

FIG. 6A is still another advantageous embodiment of the present invention including two second attractive components 22, 22' and return flux director 62 provided in the shape of a rectangular bar located below the two second attractive components 22, 22'. Again the two second attractive components 22, 22' are provided as opposite polarity magnets and the optional return flux director 62 further increases flow of magnetic flux in the circuit increasing system performance and allowing the distance between the members to be increased if necessary.

Figure 7:
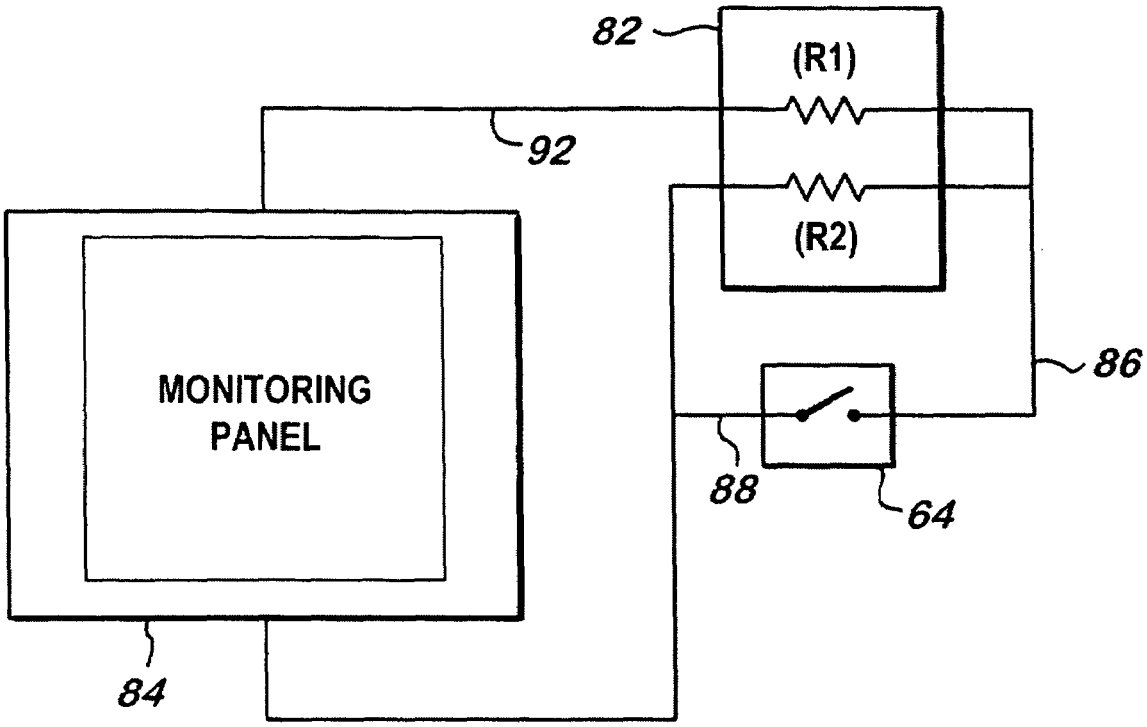
FIG. 7 is a schematic illustrating the positioning of a resistor network in the switch assembly.

FIG. 7 is an illustration of one particularly advantageous embodiment which includes the internal resistor network 82 according to the various embodiments previously described herein. Typically it has been standard practice in industry to terminate the electrical leads (86, 88) that are connected to a door switch 64 with resistors (R1) and (R2) at a monitoring panel 84 for the alarm system. When for example, the unit is in the secure position the door switch 64 is closed and the resistance at the monitoring panel 84 may equal (R1). When however, the unit is not secure the door contact is open and the total resistance at the monitoring panel 84 will then be equal to (R1)+(R2). Without resistor the indicated resistance is either 0Ω (secure) or infinite Ω (not secure). Again, it is contemplated that many differing switching logic configurations may be used. This configuration is merely provided as an example of one such configuration and is not meant to be a limitation on the invention.

A problem with this arrangement is here identified. If an intruder shorts the electrical leads (86, 88) somewhere along the path from the switch to the monitoring panel 84 the total resistance would always read 0Ω. The monitoring panel 84 then would interpret this as the unit is constantly secure allowing an intruder to bypass the security. However, positioning the resistors (R1) and (R2) inside of the door switch unit eliminates the intruder's ability to bypass the system. This is because if the potential intruder where to short electrical leads (88, 92), rather than reading resistance (R1) or "secure", the system will read 0Ω or fault, which can activate an alarm condition.

Other benefits of this arrangements is that it eliminates the additional labor costs associated with installing the resistors (R1) and (R2) in the control panel 84 as these are already factory installed in the device itself, and eliminates any potential error the installer may make in connecting the resistors (R1) and (R2) to the system.

It should further be noted that, even though the internal resistor network 82 is shown (FIG. 4) located with the components mounted to the first member 12, it may also be positioned adjacent to the components mounted to second member 14.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A magnetic switching device for detecting relative movement between a first and a second member comprising:

a switch assembly for mounting to the first member, the switch assembly including:

a first switch element and a second switch element, said second switch element positioned apart from said first switch element;

an electrically conductive shiftable body;

a first attractive component;

a flux director positioned in proximity to said shiftable body;

said shiftable body movable between a first position where the shiftable body is in simultaneous contact with said first and second switch elements, and a second position where said shiftable body is out of simultaneous contact with said first and second switch elements;

a second attractive component for mounting to said second member;

said flux director providing a reduced reluctance path for an applied magnetic field and directing at least a portion of a magnetic field emanating therefrom toward said switch assembly;

said first and second attractive components being positioned such that when the first and second members are in proximity to each other in a proximal position, said magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions; and a magnetically permeable shim positioned adjacent to and extending at least partially around said shiftable body, said magnetically permeable shim coupling at least a portion of the applied magnetic field from said flux director to said shiftable body.

2. The magnetic switching device according to claim 1 further comprising a pry tamper switch for indicating whether the switch assembly is moved relative to the first member.

3. The magnetic switching device according to claim 1 further comprising a return flux director for directing magnetic flux to the second attractive component.

4. The magnetic switching device according to claim 3 further comprising a third attractive component for mounting to said second member.

5. The magnetic switching device according to claim 4 wherein said second and said third attractive components are positioned one on each end of said return flux director oriented in opposite polarity.

6. The magnetic switching device according to claim 1 further comprising a metal back plate.

7. The magnetic switching device according to claim 1 further comprising a tamper switch for indicating the application of an applied magnetic field to the magnetic switching device.

8. A magnetic switching device for detecting relative movement between a first and a second member comprising:

a switch assembly for mounting to the first member, the switch assembly including:

a first switch element and a second switch element, said second switch element positioned apart from said first switch element;

an electrically conductive shiftable body;

a first attractive component;

a flux director positioned in proximity to said shiftable body;

said shiftable body movable between a first position where the shiftable body is in simultaneous contact with said first and second switch elements, and a second position where said shiftable body is out of simultaneous contact with said first and second switch elements;

a second attractive component for mounting to said second member;

said flux director providing a reduced reluctance path for an applied magnetic field and directing at least a portion of a magnetic field emanating therefrom toward said switch assembly;

said first and second attractive components being positioned such that when the first and second members are in proximity to each other in a proximal position, said magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions; and wherein said first attractive component comprises a bias ring positioned around said shiftable body member, the magnetic field emanating from the flux director coupling to the bias ring.

9. The magnetic switching device according to claim 8 wherein a resistor network for indicating an open or close door position is located inside of the magnetic switching device.

10. A magnetic switching device for detecting relative movement between a first and a second member comprising:

a switch assembly that has an electrically conductive shiftable body that shifts between simultaneous contact with two switch elements and non-simultaneous contact with the two switch elements based upon applied magnetic fields generated by first and second attractive components, the switch assembly further including:

a flux director positioned in proximity with the shiftable body;

said flux director providing a reduced reluctance path for an applied magnetic field and directing at least a portion of a magnetic field emanating therefrom toward said switch assembly;

said first and second attractive components being positioned such that when the first and second members are in proximity to each other in a proximal position, said magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions; and wherein said first attractive component comprises a bias ring positioned around said shiftable body, the magnetic field emanating from the flux director coupling to the bias ring.

11. The magnetic switching device according to claim 10 further comprising a tamper switch for indicating the application of an applied magnetic field to the magnetic switching device.

12. The magnetic switching device according to claim 10 further comprising a pry tamper switch for indicating whether the switch assembly is moved relative to the first member.

13. The magnetic switching device according to claim 10 further comprising a return flux director for directing magnetic flux to the second attractive component.

14. The magnetic switching device according to claim 10 wherein a resistor network for indicating an open or close door position is located inside of the magnetic switching device.

15. A magnetic switching device for detecting relative movement between a first and a second member and for sending a signal indicative of the relative movement to a control panel comprising:

a switch assembly that has an electrically conductive shiftable body that shifts between simultaneous contact with two switch elements and non-simultaneous contact with the two switch elements based upon applied magnetic fields generated by first and second attractive components the first attractive component including a bias ring positioned around the shiftable body, the switch assembly further including:

said first and second attractive components being positioned such that when the first and second members are in proximity to each other in a proximal position, a magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions; and a resistor network positioned in the magnetic switching device for sending, via a set of control leads, a signal indicative of the relative movement between a first and a second member to the control panel.

16. The magnetic switching device according to claim 15 wherein said resistor network comprises:

a first resistor (R1) and a second resistor (R2), where R1 is electrically connected in series with said switch assembly, and where R2 is electrically connected in parallel with said switch assembly.

17. The magnetic switching device according to claim 16 wherein when the switch assembly is closed the control panel will read a circuit resistance approximately equal to R1, when the switch assembly is open the control panel will read a circuit resistance approximately equal to R1+R2, and when the control leads are shorted the control panel will read a circuit resistance approximately equal to 0Ω.

18. The magnetic switching device according to claim 15 wherein said flux director is positioned in proximity with the shiftable body, said flux director providing a reduced reluctance path for an applied magnetic field.

19. A magnetic switching device for detecting relative movement between a first and a second member and for sending a signal indicative of the relative movement to a control panel comprising:

a switch assembly that has an electrically conductive shiftable body that shifts between simultaneous contact with two switch elements and non-simultaneous contact with the two switch elements based upon applied magnetic fields generated by first and second attractive components, the first attractive component including a bias ring positioned around the shiftable body;

said first and second attractive components being positioned such that when the first and second members are in proximity to each other in a proximal position, a magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions.

20. The magnetic switching device according to claim 19 further comprising a tamper switch for indicating the application of an applied magnetic field to the magnetic switching device.

21. The magnetic switching device according to claim 19 further comprising a pry tamper switch for indicating whether the switch assembly is moved relative to the first member.

22. The magnetic switching device according to claim 19 wherein said bias ring extends continuously and completely around the shiftable body to increase switching repeatability.

23. A magnetic switching device for detecting relative movement between a first and a second member comprising:

a switch assembly including a first part and a second part positioned on the first and second member respectively;

said first part having:

a first magnetic component;

a shiftable body;

a flux director positioned in proximity with the shiftable body;

said second part having:

a second magnetic component;

a return flux director for directing magnetic flux to the second magnetic component; and said shiftable body shifting between simultaneous contact with two switch elements and non-simultaneous contact with the two switch elements based upon applied magnetic fields generated by first and second magnetic components;

said flux director directing magnetic flux emanating from a first pole of said second magnetic component to said shiftable body;

said return flux director extending toward said shiftable body so as to capture the magnetic flux and return it to a second pole of said second magnetic component.

24. The magnetic switching device according to claim 23 wherein said flux concentrator is provided with a magnetic receiving surface for receiving a magnetic field and an active surface from which the received magnetic field emanates, said receiving surface being substantially parallel with said active surface.

25. The magnetic switching device according to claim 24 further comprising a second active surface that is substantially perpendicular to said receiving surface.

26. The magnetic switching device according to claim 25 wherein said flux concentrator is magnetically coupled directly to said second magnetic component.

27. A magnetic switching device for detecting relative movement between a first and a second member and for sending a signal indicative of the relative movement to a control panel comprising:

a switch assembly that has an electrically conductive shiftable body that shifts between simultaneous contact with two switch elements and non-simultaneous contact with the two switch elements based upon applied magnetic fields generated by first and second attractive components;

a permeable shim positioned adjacent to and extending at least partially around the shiftable body and coupling an applied magnetic field to the shiftable body;

said first and second attractive components being positioned such that when the first and second members are in proximity to each other in a proximal position, a magnetic flux directing device allows a threshold level of magnetic flux to be applied to said shiftable body so that said shiftable body is moved to one of the first or second positions, and when the first and second members are moved out of proximity to each other in a distal position, said shiftable body is moved to the other of the first or second positions.

28. The magnetic switching device according to claim 27 further comprising a tamper switch for indicating the application of an applied magnetic field to the magnetic switching device.

29. The magnetic switching device according to claim 27 further comprising a pry tamper switch for indicating whether the switch assembly is moved relative to the first member.

* * * * *